US009077105B2

(12) United States Patent
Kim

(10) Patent No.: US 9,077,105 B2
(45) Date of Patent: Jul. 7, 2015

(54) STRUCTURE OF ELECTROMAGNETIC ELECTRICAL CONNECTION DEVICE

(75) Inventor: Nam Ku Kim, Seoul (KR)

(73) Assignee: AUTOCONNECTOR CO., LTD., Gyeonggi-do (KR)

( * ) Notice: Subject to any disclaimer, the term of this patent is extended or adjusted under 35 U.S.C. 154(b) by 38 days.

(21) Appl. No.: 14/113,943

(22) PCT Filed: Apr. 26, 2012

(86) PCT No.: PCT/KR2012/003219

§ 371 (c)(1),
(2), (4) Date: Nov. 28, 2013

(87) PCT Pub. No.: WO2012/148178

PCT Pub. Date: Nov. 1, 2012

(65) Prior Publication Data

US 2014/0162468 A1 Jun. 12, 2014

(30) Foreign Application Priority Data

Apr. 27, 2011 (KR) ..... 10-2011-0039441

(51) Int. Cl.
*H01R 11/30* (2006.01)
*H01R 13/62* (2006.01)

(52) U.S. Cl.
CPC ..... *H01R 13/6205* (2013.01)

(58) Field of Classification Search
CPC ..... H01R 13/6205
USPC ..... 439/38, 39, 40, 928
See application file for complete search history.

(56) References Cited

U.S. PATENT DOCUMENTS

| | | | | |
|---|---|---|---|---|
| 3,363,214 | A * | 1/1968 | Wright | 439/39 |
| 3,808,577 | A | 4/1974 | Mathauser | |
| 5,486,116 | A | 1/1996 | Meiler et al. | |
| 5,954,520 | A | 9/1999 | Schmidt | |
| 7,329,128 | B1 | 2/2008 | Awad et al. | |
| 7,364,443 | B1 * | 4/2008 | McGinnis et al. | 439/131 |
| 7,828,556 | B2 * | 11/2010 | Rodrigues | 439/38 |
| 2014/0099808 | A1 * | 4/2014 | McClelland | 439/153 |
| 2014/0162468 | A1 * | 6/2014 | Kim | 439/39 |

FOREIGN PATENT DOCUMENTS

| | | | |
|---|---|---|---|
| CN | 101950904 | A | 1/2011 |
| DE | 10 2008 038 641 | A1 | 3/2009 |
| JP | 06-231826 | A | 8/1994 |
| KR | 10-2002-0080766 | A | 10/2002 |
| KR | 10-2012-0080924 | A | 7/2012 |

OTHER PUBLICATIONS

European Patent Office, European Search Report of European Patent Application No. 12776818.2, Mar. 12, 2015.

* cited by examiner

*Primary Examiner* — Phuongchi T Nguyen
(74) *Attorney, Agent, or Firm* — IP Legal Services, LLC

(57) ABSTRACT

The present invention relates to an improved structure of an electromagnetic electrical connection device. To this end, the present invention comprises first and second electromagnetic electrical connectors (100, 100*a*) which electrically connect the electromagnetic electrical connection device to an electronic product by magnetic force, and is capable of blocking of noise while being connected, and provides stability, convenience, and waterproofing functions, wherein the first and second electromagnetic electrical connectors (100, 100*a*) include an outlet body (110) fixedly provided on a product and a plug body (150) selectively detachable from the outlet body (110).

12 Claims, 16 Drawing Sheets

STRUCTURE OF ELECTROMAGNETIC ELECTRICAL CONNECTION DEVICE

CROSS REFERENCE TO RELATED APPLICATIONS

This application is a National Stage Patent Application of PCT International Patent Application No. PCT/KR2012/003219 (filed on Apr. 26, 2012) under 35 U.S.C. §371, which claims priority to Korean Patent Application No. 10-2011-0039441 (filed on Apr. 27, 2011), the teachings of which are incorporated herein in their entireties by reference.

TECHNICAL FIELD

The present invention relates to an improved structure of an electromagnetic electrical connection device capable of being applied to a variety of electronic products (for example, plugs, outlets, typical or waterproof connectors, sockets, jacks, adaptors, etc.) so as to be widely used. More particularly, the present invention allows electrical or signal connection to be smoothly performed using properties of magnetic force so as to conveniently provide electrical connection and disconnection while providing effects such as noise isolation, stability, and waterproofing functions during connection of the electrical connection device, thereby significantly improving quality and reliability of the product to present a good image to a user which is a consumer.

BACKGROUND ART

The present invention is to further improve Korean Patent Application No. 2011-0002404 (entitled "The ELECTROMAGNETIC ELECTRICAL CONNECTION DEVICE") which is previously applied by the present applicant.

As well known in the art, power is connected to an outlet as an interior wiring connector so as to be supplied to a variety of electronic products requiring power. A plug is installed to an end of a cable of an electronic product such that power is shut off and the cable is arranged when the plug is decoupled from the outlet, thereby easily transporting and storing the electronic product. Power is supplied to the electronic product when the plug is connected to the outlet, and thus the electronic product operates.

In a plug and an outlet as conventional power connection mechanisms related to such an art, as shown in FIG. 1, a plug 40 is installed to a cable 41 joined to an electronic product and plug terminals 40*a* protrude from an end of the plug 40. An outlet 50 is installed such that the plug terminals 40*a* of the plug 40 are inserted into the outlet 50. The outlet 50 is formed, at the front thereof, with a hole 51 and terminal insertion grooves 52 are symmetrically formed on a bottom surface of the hole 51.

In the conventional plug and outlet, the cable is connected, at one end thereof, to a power supply of the electronic product while being provided, at the other end thereof, with the plug 40, and the plug terminals 40*a* protrude from the end of the plug 40. When the plug terminals 40*a* of the plug 40 are inserted into the terminal insertion grooves 52 formed in the hole 51 of the outlet 50, the plug terminals 40*a* are electrically connected to connection pieces which are installed inside the terminal insertion grooves 52 to be connected to power, thereby supplying the power to the electronic product.

The plug 40 and the outlet 50 as the power connection mechanisms which are inserted and fastened as described above are inconvenient in that, when the plug 40 is fitted into the outlet 50 in the dark and narrow place, the plug terminals 40*a* of the plug 40 are exactly inserted into the terminal insertion grooves 52 of the outlet 50.

In addition, when the plug terminals 40*a* of the plug 40 are tightly inserted into the terminal insertion grooves 52 of the outlet 50, large force is required to decouple the plug 40. Furthermore, since there is a need to pull the cable joined to the plug 40 when the plug 40 is well not decoupled from the outlet 50, a short circuit may be generated at a connection part between the plug and the cable.

Meanwhile, the terminal insertion grooves 52 into which the plug terminals 40*a* of the plug 40 are inserted in the hole 51 of the outlet 50 are always opened. Accordingly, when children insert conductive objects into the terminal insertion grooves 52 due to curiosity, an electric shock accident may be caused. In addition, when foreign matters are inserted into the terminal insertion grooves 52, the plug terminals 40*a* of the plug 40 may not be inserted into the terminal insertion grooves 52.

The solution of the above-mentioned problems is disclosed in Korean Unexamined Patent Application Publication No. 2002-0080766 (Korean Patent Application No. 2001-0020525) of the relate art.

That is, the above relate art is constituted as shown in FIG. 2. A plug insertion portion 4 having a groove shape is formed in a case 3 of an outlet 2, and a plurality of power terminals 5 and 5' are formed on the plane within the groove of the plug insertion portion 4. The plug insertion portion 4 is provided therein with first magnets 6 and 6' to fix a plug 1 by magnetic force, and the plug 1 is provided with second magnets 7 and 7' to fix the plug 1 to the plug insertion portion 4 by attractive force acting on positions corresponding to the first magnets 6 and 6'.

In addition, the plug 1 is formed with a plurality of plug terminals 8 and 8' on the contact surface of the plug 1 so as to correspond to the plural power terminals 5 and 5' formed within the plug insertion portion 4. The case 3 of the outlet 2 is formed therein with safety switches 10 and 10' which turn on/off power by magnetic force, and the plug 1 is formed with third magnets 9 and 9' to operate the safety switches 10 and 10' by magnetic force. In this case, the safety switches 10 and 10' include first contact 11 and 11' connected to the power terminals 5 and 5', second contacts 12 and 12' connected to power supply lines 20 and 20', switch portions 13 and 13' which move by magnetic force of the third magnets 9 and 9' and connect the first contact 11 and 11' to the second contacts 12 and 12', and elastic bodies 14 and 14' which are elastic restoring means to return the switch portions 13 and 13' to original positions when the magnetic force of the third magnets 9 and 9' do not affected thereto, respectively. In this case, the switch portions 13 and 13' are ferromagnetic bodies and conductive substances, and are configured to be moved by attractive force acting between the third magnets 9 and 9' and the switch portions 13 and 13'.

However, the switch portions 13 and 13' may also be moved by installing magnets to the switch portions 13 and 13' such that repulsive force acts between the third magnets 9 and 9' and the switch portions 13 and 13'. In addition, in order to easily adjust contact positions between the power terminals 5 and 5' and the plug terminals 8 and 8', the related art is configured such that the contact positions may be exactly adjusted by attractive force by forming concave-convex portions at the installation positions of the first magnets 6 and 6', the second magnets and 7', and the third magnets 9 and 9'. However, the related art may also be configured such that coupling directions and positions between the power terminals 5 and 5' and the plug terminals 8 and 8' may be exactly adjusted by forming separate concave-convex portions in addition to such a configuration.

Accordingly, if the plug 1 is inserted into the plug insertion portion 4 of the outlet 2, attractive force acts between the first magnets 6 and 6' formed in the outlet 2 and the second magnets 7 and 7' formed in the plug 1. Consequently, the plug 1 may be inserted into and simply attached to the plug insertion portion 4 of the outlet 2 without separation from each other. Thus, the power terminals 5 and 5' of the outlet 2 come into contact with the plug terminals 8 and 8' of the plug 1, thereby forming a circuit.

In addition, the power terminals 5 and 5' come into contact with the plug terminals 8 and 8' and the switch portions 13 and 13' of the safety switches 10 and 10' are moved by attractive force of the third magnets 9 and 9' so as to connect the first contacts 11 and 11' to the second contacts 12 and 12', with the consequence that the power supply lines 20 and 20' and the power terminals 5 and 5' are connected to each other. Consequently, the circuit is formed such that power is supplied to the power terminals 5 and 5' and is supplied to the electronic product through the plug terminals 8 and 8' coming into contact with the power terminals 5 and 5'.

Meanwhile, in a case of decoupling the plug 1 from the plug insertion portion 4 of the outlet 2, the plug 1 and the plug insertion portion 4 may be easily separated from each other even when large force is not applied thereto only because of coming into contact with each other by attractive force of the magnets. When the plug 1 is decoupled from the plug insertion portion 4 of the outlet 2, the power terminals 5 and 5' and the plug terminals 8 and 8' are separated from each other and the attractive force of the third magnets 9 and 9' which allows the switch portions 13 and 13' of the safety switches 10 and 10' to be moved is removed. As a result, as the switch portions 13 and 13' are returned to original positions by the elastic bodies 14 and 14', the connection between the first contact 11 and 11' and the second contacts 12 and 12' is disconnected so that power is not supplied to the power terminals 5 and 5'. Accordingly, even if the power terminals 5 and 5' are touched by a user's fingers or come into contact with chopsticks or the like, electrical accidents may be prevented in advance because the power is not supplied thereto.

However, the above related art has the following several problems.

That is, the above related art is pointed out as a major problem in that it may not be used in other electronic products in addition to having simple functions such as the plug and the outlet.

Particularly, the above related art has a serious problem in that it may not be possible to provide various effects such as noise isolation, stability, and waterproofing functions during connection of an electrical connection device.

DISCLOSURE

Technical Problem

Accordingly, the present invention has been made in view of the above-mentioned problems, and is to provide an improved structure of an electromagnetic electrical connection device capable of achieving the following objects: a first object of the present invention is to include first to eleventh electromagnetic electrical connection parts; a second object thereof is to enable electrical or signal connection to be smoothly performed using properties of magnetic force so as to conveniently provide electrical connection and disconnection; a third object thereof is to provide effects such as noise isolation, stability, and waterproofing functions during connection of the electrical connection device; and a fourth object thereof is to significantly improve quality and reliability of a product to present a good image to a user which is a consumer.

Technical Solution

In order to achieve such objects, the present invention provides an improved structure of an electromagnetic electrical connection device including first and second electromagnetic electrical connection parts which realize noise isolation, stability, and waterproofing functions during electrical connection of the electrical connection device of an electronic product by magnetic force, wherein the first and second electromagnetic electrical connection parts include an outlet body which is fixedly installed to the product and a plug body which is selectively detachable from the outlet body, respectively.

Advantageous Effects

As is apparent from the above description, the present invention includes first to eleventh electromagnetic electrical connection parts.

The present invention according to such a technical configuration enables electrical or signal connection to be smoothly performed using properties of magnetic force so as to conveniently provide electrical connection and disconnection.

In addition, the present invention may provide effects such as noise isolation, stability, and waterproofing functions during connection of an electrical connection device.

The present invention may significantly improve quality and reliability of a product to present a good image to a user which is a consumer by the above effects.

Additional advantages, objects, and features of the invention will be set forth in part in the description which follows and in part will become apparent to those having ordinary skill in the art upon examination of the following or may be learned from practice of the invention.

BRIEF DESCRIPTION OF DRAWINGS

The above and other objects, features and other advantages of the present invention will be more clearly understood from the following detailed description taken in conjunction with the accompanying drawings.

BEST MODE FOR INVENTION

Figure 1:
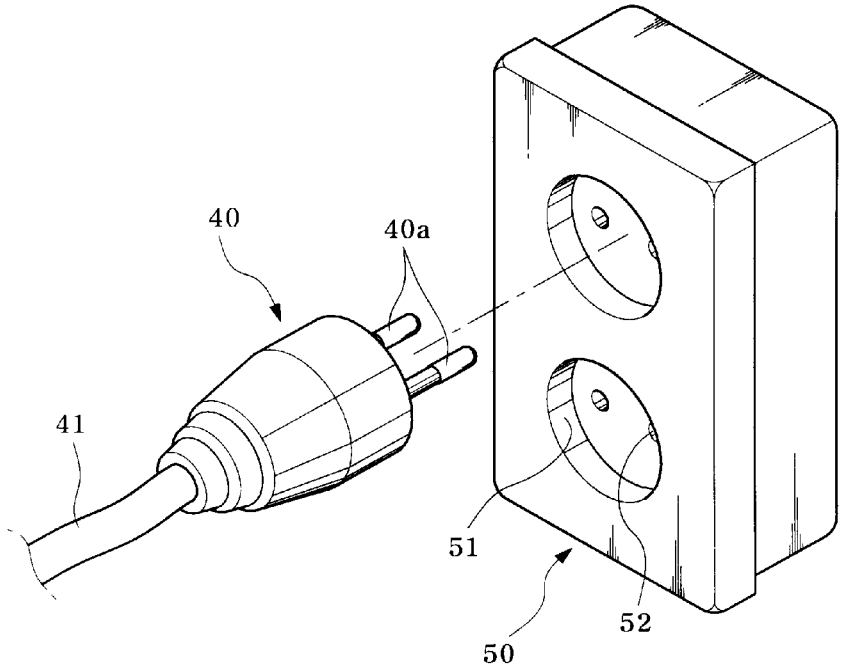
FIG. 1 is a perspective view illustrating a plug and an outlet which are conventional power connection mechanisms.
Figure 2:
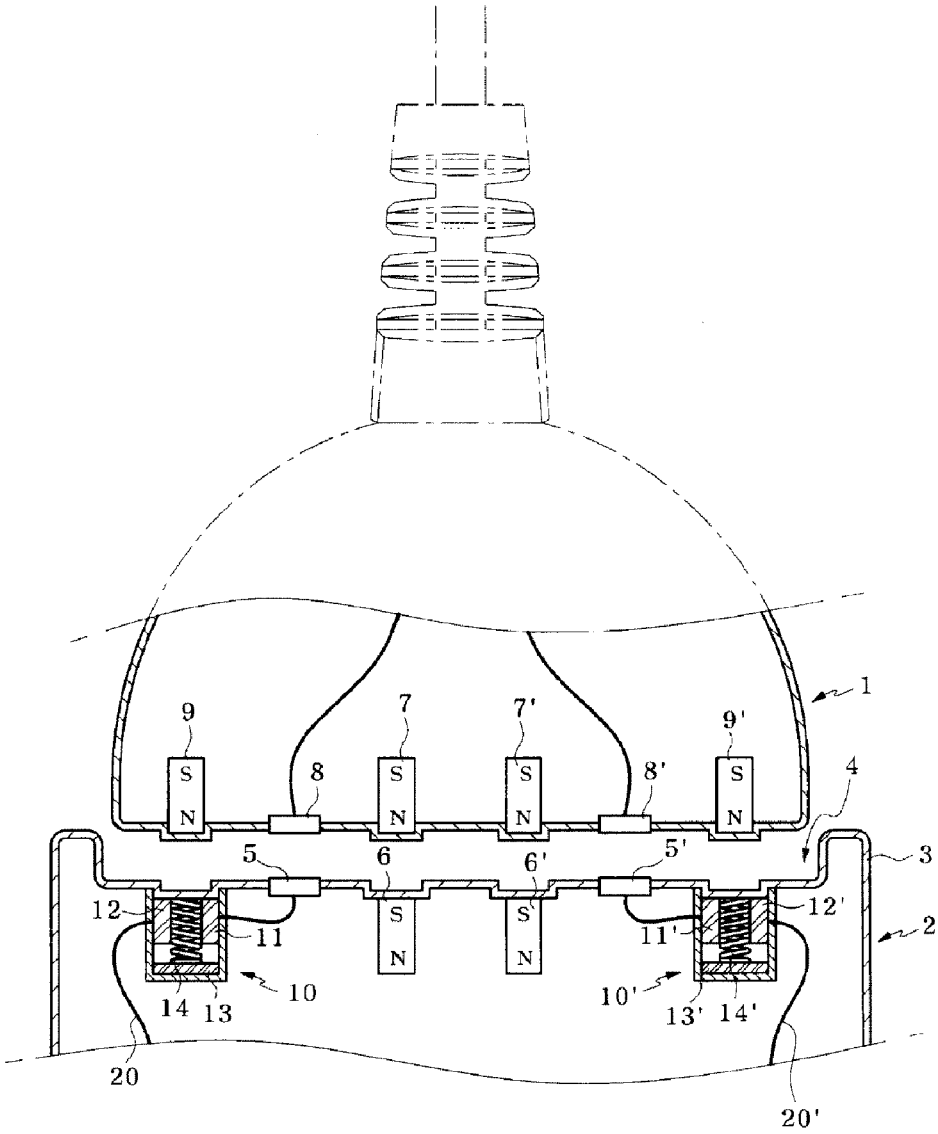
FIG. 2 is a cross-sectional view illustrating conventional power connection mechanisms using magnets.

Reference will now be made in detail to embodiments of the present invention, examples of which are illustrated in the accompanying drawings.

An improved structure of an electromagnetic electrical connection device applied to the present invention is configured as shown in FIGS. 3 to 18.

Hereinafter, in the description of the present invention, if it is determined that the detailed description for the related known function or configuration can unnecessarily obscure the gist of the present invention, the detailed description thereof will be omitted.

In addition, terms to be described later are terms defined in consideration of functions of the present invention, and these may vary with the intention or practice of a user. Therefore, such terms should be defined based on the entire content disclosed herein.

First, a description will be given of first and second embodiments of an electromagnetic electrical connection device according to the present invention.

That is, an electromagnetic electrical connection device includes first and second electromagnetic electrical connection parts 100 and 100*a* which realize noise isolation, stability, and waterproofing functions during electrical connection of the electrical connection device of an electronic product by magnetic force, and the first and second electromagnetic electrical connection parts 100 and 100*a* include an outlet body 110 which is fixedly installed to the product and a plug body 150 which is selectively detachable from the outlet body 110, respectively.

Particularly, the outlet body 110 is configured as follows.

That is, the outlet body 110 includes an inner operation space portion 111 and a plurality of connection terminals 113 which are arranged at regular intervals on one side locking protrusion 112.

The outlet body 110 includes a housing 115 which is installed inside the operation space portion 111 to selectively slide.

In addition, the outlet body 110 includes a magnet 116 which is fixedly installed to the housing 115.

The outlet body 110 includes a plurality of outlet terminal operation portions 120 which are installed at regular intervals to the housing 115 such that the outlet terminal operation portions 120 come into contact with or are decoupled from the connection terminals.

Furthermore, the housing 115 is provided with a magnetic attenuation iron 117 to prevent magnetic properties of the magnet 116 from being transferred to the product.

Meanwhile, each of the outlet terminal operation portions 120 is configured as follows.

That is, the outlet terminal operation portion 120 includes a spring connector 120*a*, opposite ends of which are respectively formed with spring operation grooves 121 and 122.

The outlet terminal operation portion 120 includes a main outlet terminal 130 and an auxiliary outlet terminal 135 which are respectively fitted into the spring operation grooves 121 and 122.

In addition, the outlet terminal operation portion 120 includes a spring 131 which is installed inside the main outlet terminal 130.

The outlet terminal operation portion 120 includes a spring 136 which is installed on an intermediate outer peripheral surface of the auxiliary outlet terminal 135.

Meanwhile, the plug body 150 is configured as follows.

That is, the plug body 150 includes a housing 160 which is fixedly installed to an inner locking groove 151.

In addition, the plug body 150 includes a magnet or an iron 161 which is fixedly installed to the housing 160.

The plug body 150 includes plug terminal operation portions 170 and 180 which are installed at regular intervals to the housing 160 such that the plug terminal operation portions 170 and 180 selectively come into contact with or are decoupled from the connection terminals 113.

Particularly, the plug terminal operation portion 170 includes a spring connector 190 in which a main plug terminal 195 is installed at a front end thereof and a spring 193 is fitted into an inner spring operation groove 191.

In addition, the plug terminal operation portion 180 includes a spring connector 190 in which a main plug terminal 195 is installed at a front end thereof and a spring 193 is fitted into an inner spring operation groove 191; and an auxiliary plug terminal 196 which is provided at one end of the spring connector 190 and in which a spring 194 is fitted into an inner spring operation groove 192.

Hereinafter, operation effects of the first and second embodiments of the electromagnetic electrical connection device according to the present invention having the above-mentioned configure will be described.

Figure 3:
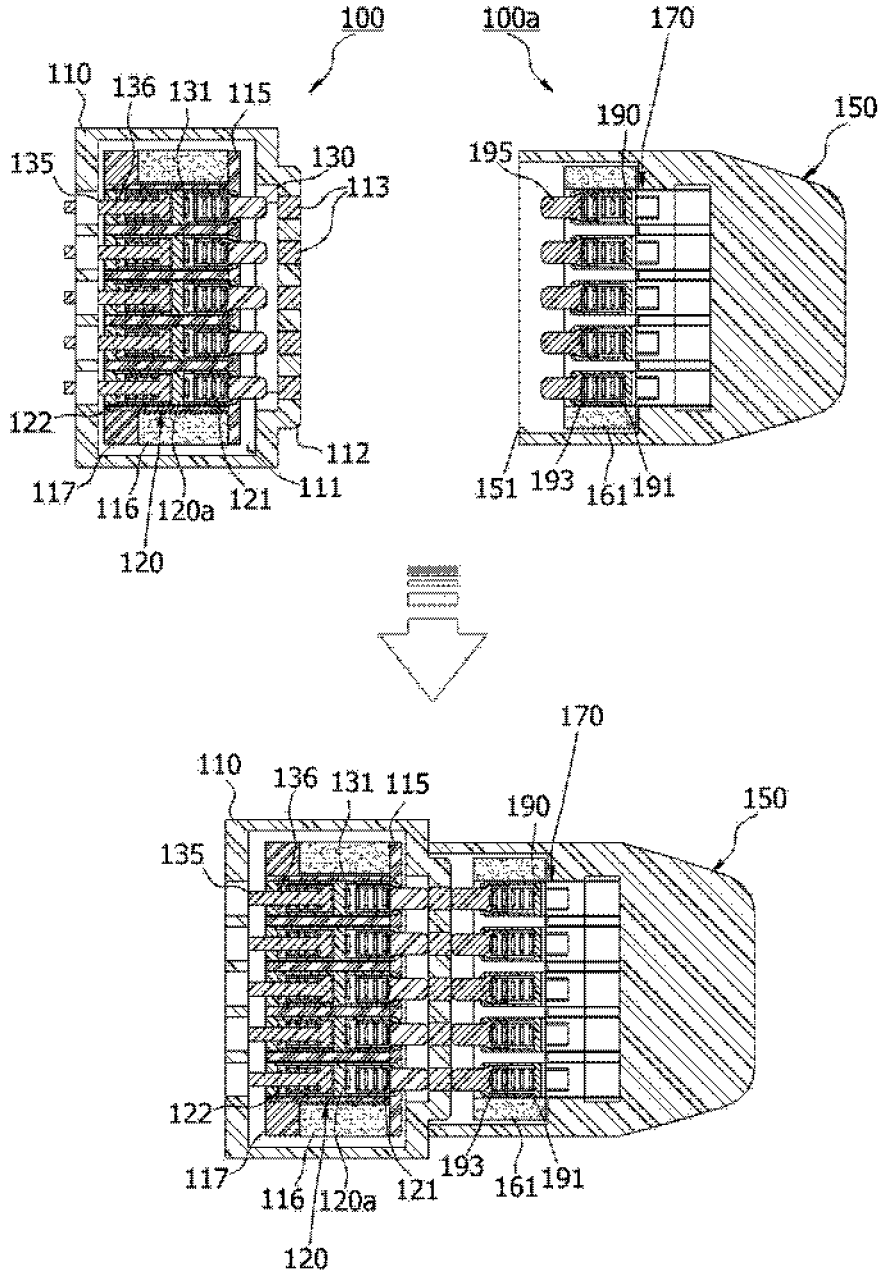
FIG. 3 is a view illustrating a configuration of a first embodiment of an electromagnetic electrical connection device applied to the present invention.
Figure 4:
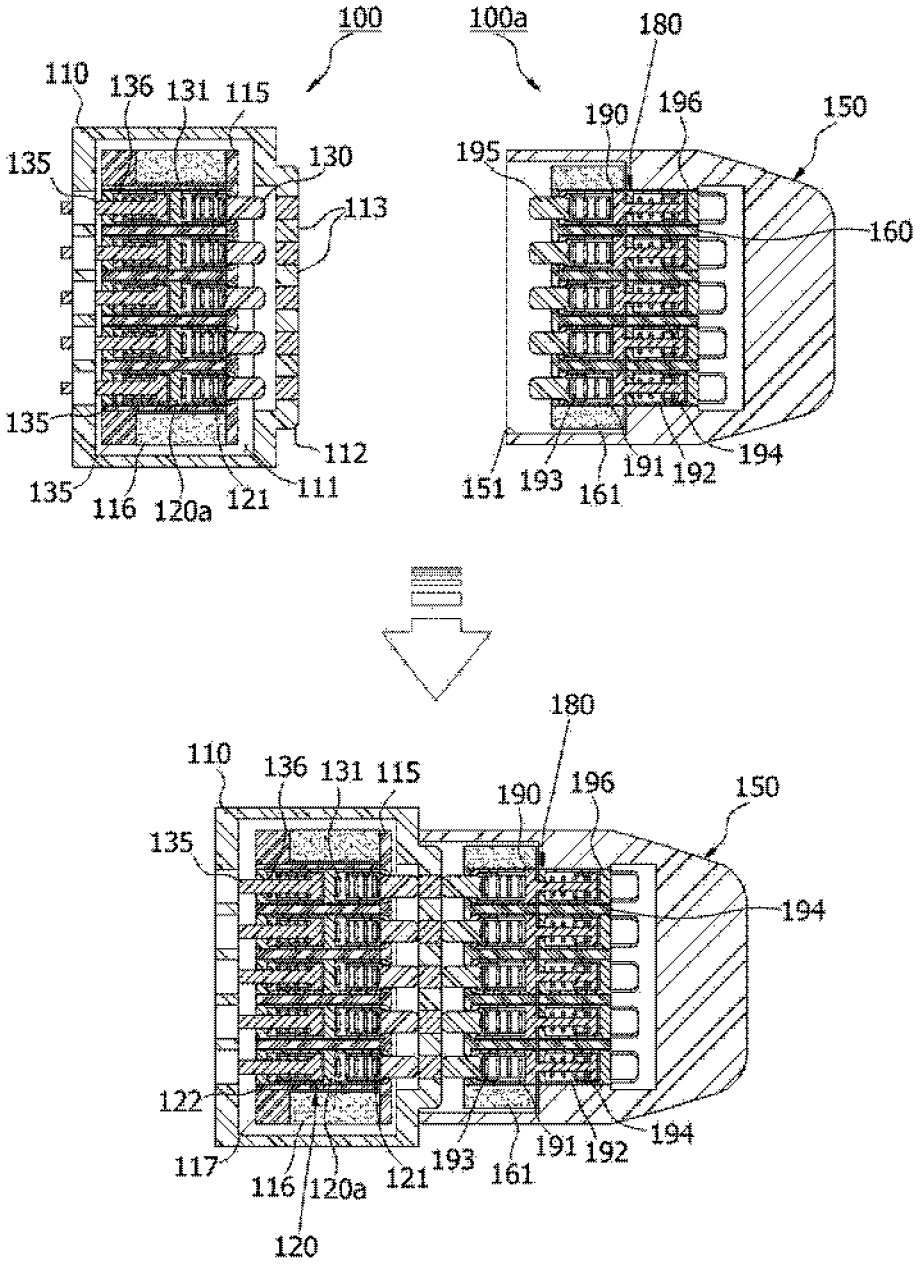
FIG. 4 is a view illustrating a configuration of a second embodiment of the electromagnetic electrical connection device applied to the present invention.
Figure 5:
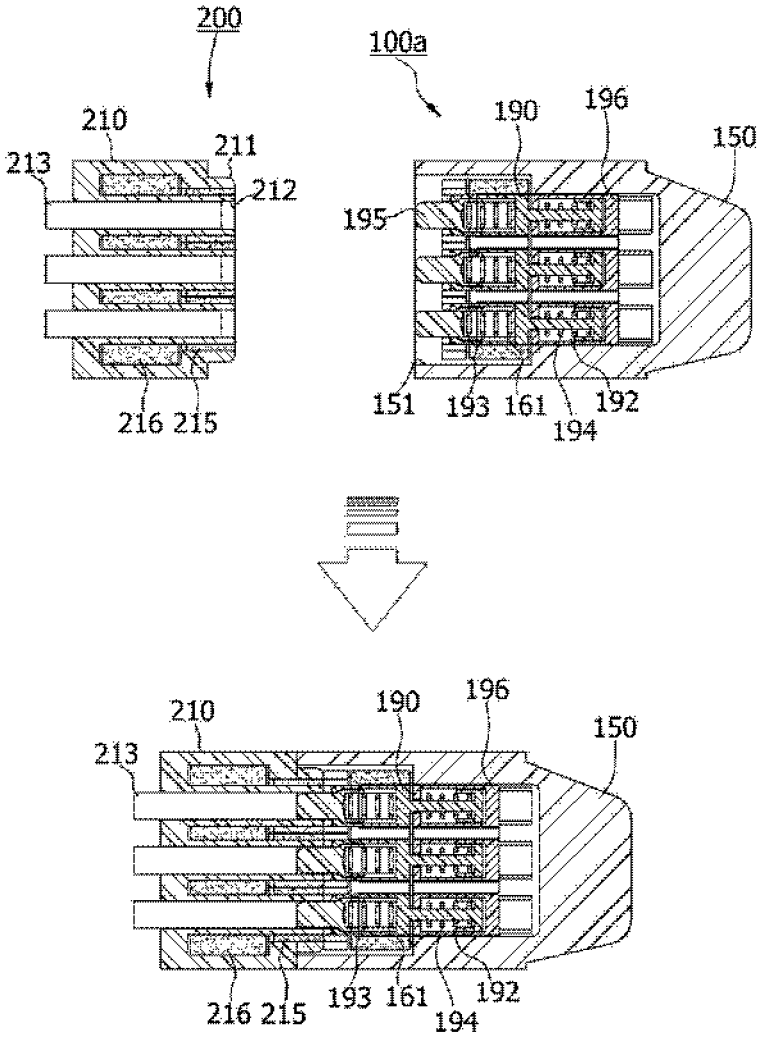
FIG. 5 is a view illustrating a configuration of a third embodiment of the electromagnetic electrical connection device applied to the present invention.
Figure 6:
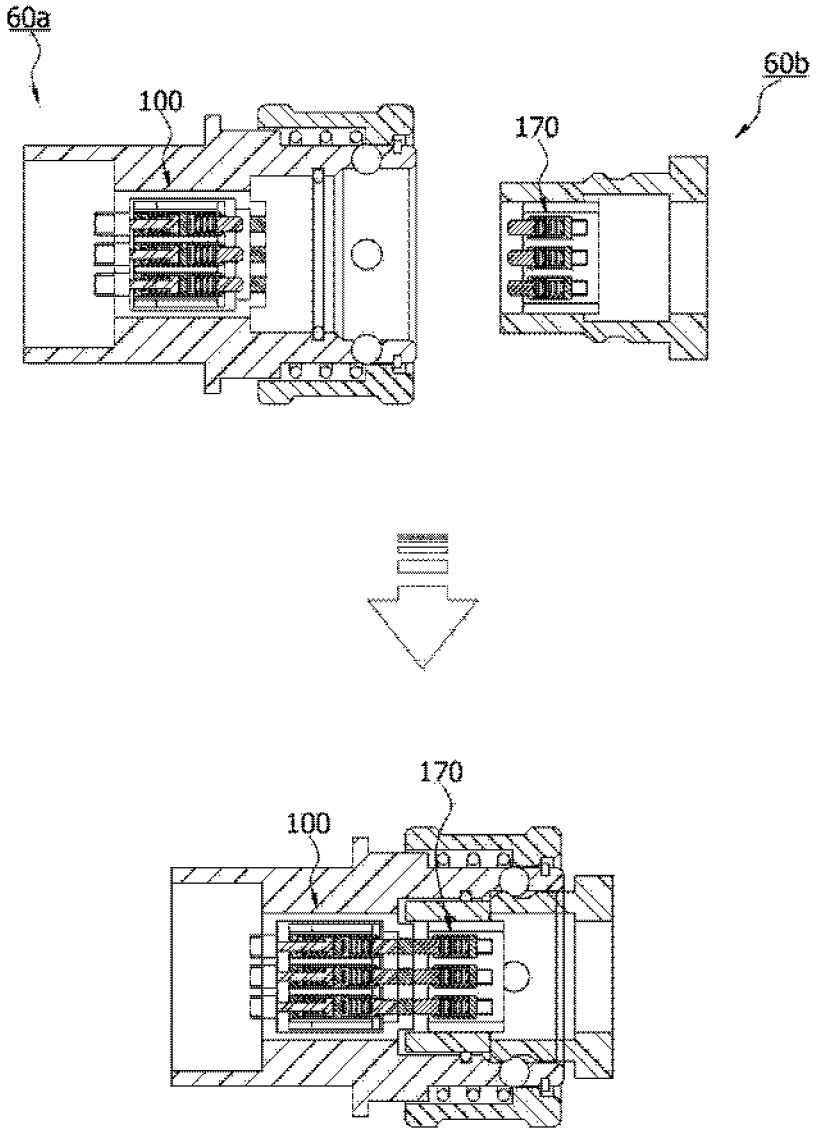
FIG. 6 is a view illustrating a state using the electromagnetic electrical connection device applied to the present invention.
Figure 7:
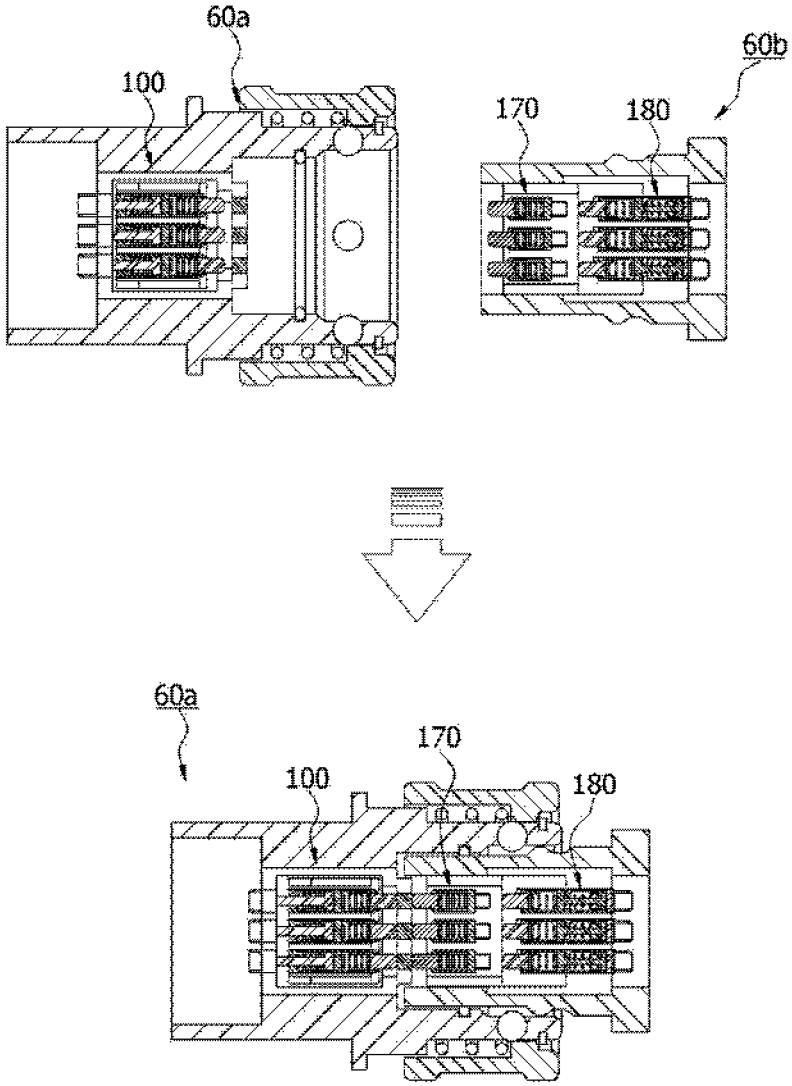
FIG. 7 is a view illustrating a state using the electromagnetic electrical connection device applied to the present invention.
Figure 8:
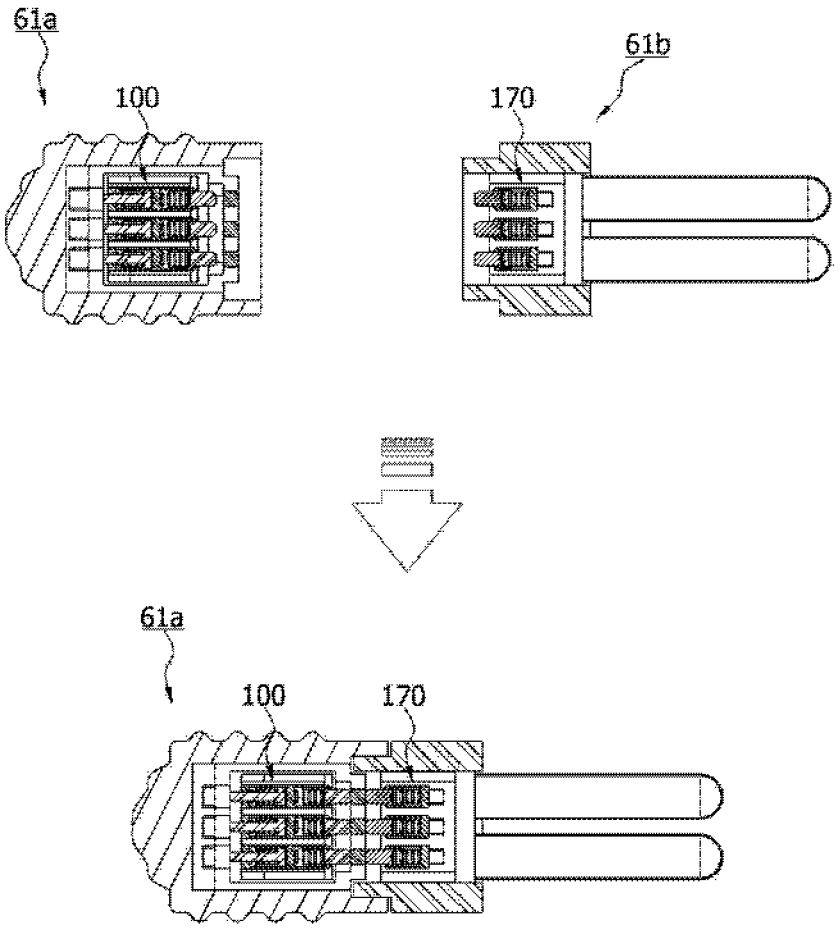
FIG. 8 is a view illustrating a state using the electromagnetic electrical connection device applied to the present invention.
Figure 9:
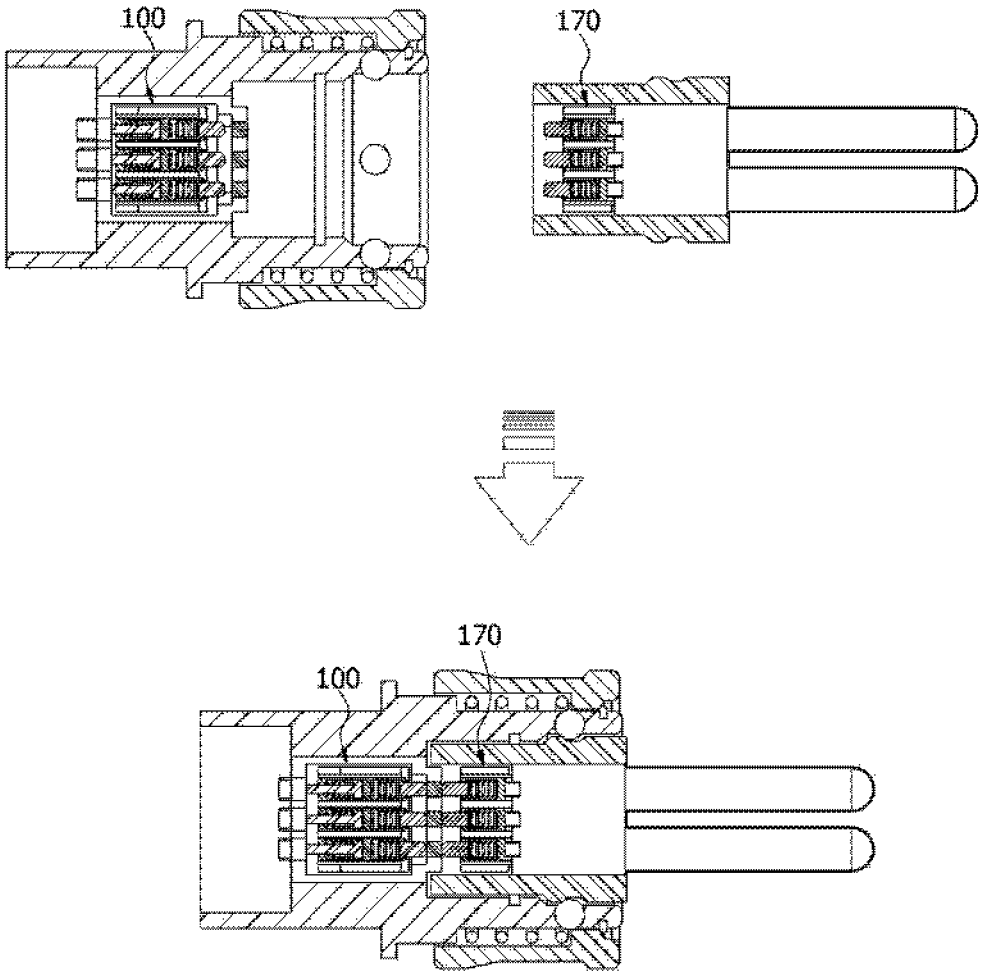
FIG. 9 is a view illustrating a state using the electromagnetic electrical connection device applied to the present invention.
Figure 10:
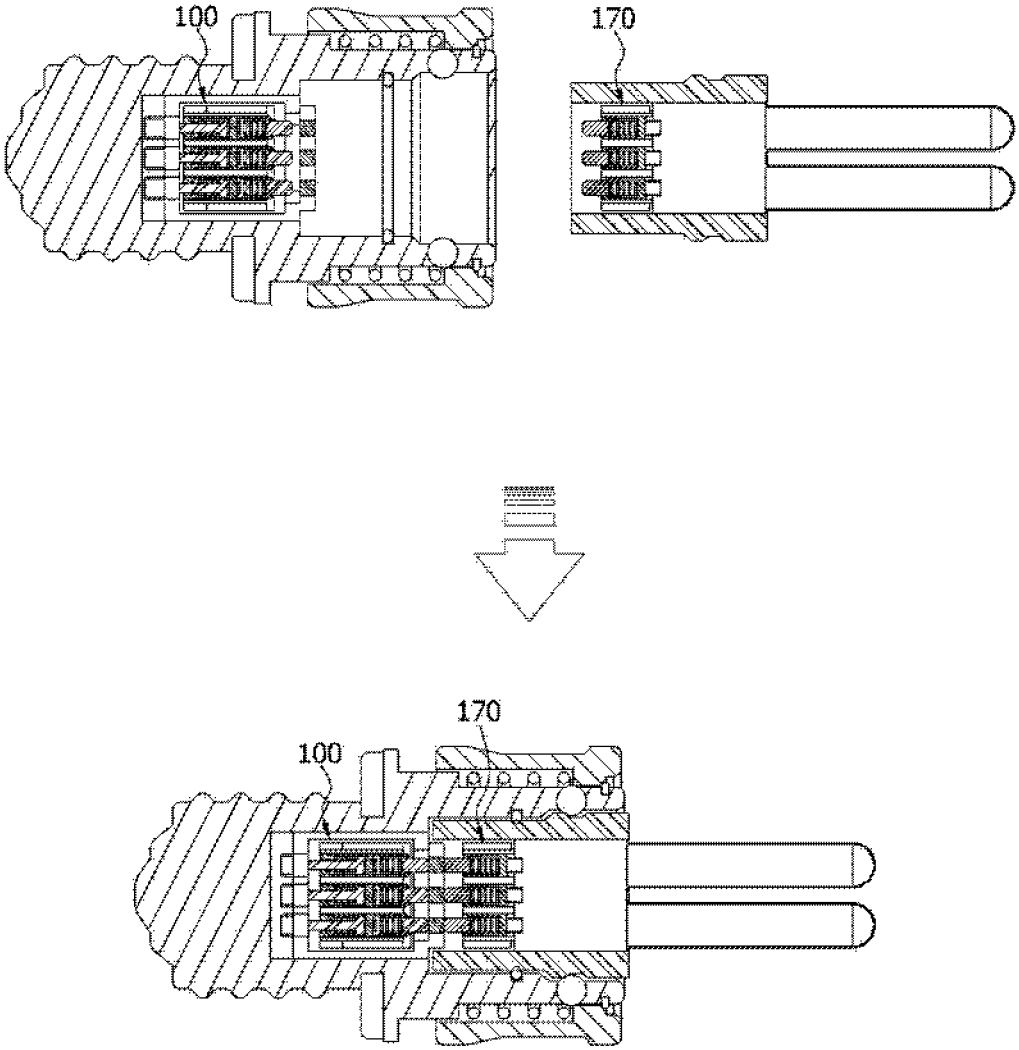
FIG. 10 is a view illustrating a state using the electromagnetic electrical connection device applied to the present invention.

FIG. 3 is a view illustrating a configuration of the first embodiment of the electromagnetic electrical connection device applied to the present invention. FIG. 4 is a view illustrating a configuration of the second embodiment of the electromagnetic electrical connection device applied to the present invention. The electromagnetic electrical connection device is configured such that, when magnetic substances (magnets) are joined to each other in a state in which terminals composed of an outer terminal and an inner terminal are separated from each other, the terminals are connected by magnetic force.

First, referring to FIG. 4, the second embodiment of the present invention will be described prior to the first embodiment.

The upper drawing shows a mutual separated state of the first and second electromagnetic electrical connection parts 100 and 100*a*. The lower drawing indicated by the arrow shows a coupled state of the first and second electromagnetic electrical connection parts 100 and 100*a*.

In the upper drawing, the housing 115 and the outlet terminal operation portion 120 of the first electromagnetic electrical connection part 100 are located at one side in a non-operated state. The plug terminal operation portion 180 of the second electromagnetic electrical connection part 100*a* is located in a non-operated state.

In such a state, when the second electromagnetic electrical connection part 100*a* approach the first electromagnetic electrical connection part 100, the parts come into close contact with each other by magnetic force as shown in the lower drawing.

That is, when the locking protrusion 112 is fitted into the locking groove 151, the parts are closely pressed against each other by magnetic properties of the magnets 116 and 161. In such a state, the main plug terminal 195 is connected to the connection terminal 113 and the connection terminal 113 comes into contact with the main outlet terminal 130 and the auxiliary outlet terminal 135, thereby enabling power to be applied to the electrical connection device.

In this case, the spring 194 located at the spring operation groove 192 is compressed forward by properties of magnetic force during mutual contact of the parts, and the spring 193 located at the spring operation groove 191 is compressed rearward during mutual contact of the main plug terminal 195 and the connection terminal 113.

In addition, the spring 136 located at the spring operation groove 122 is compressed forward during forward advance of the housing 115, and the spring 131 located at the spring operation groove 121 is compressed rearward during mutual contact of the main outlet terminal 130 and the connection terminal 113.

As a result, the springs 193 and 131 serve to provide tension to the terminals and the springs 194 and 136 retreat while adjusting lengths thereof.

Of course, when the first and second electromagnetic electrical connection parts 100 and 100*a* are again spaced apart from each other in the above state, the first and second electromagnetic electrical connection parts 100 and 100*a* are separated from each other as shown in the upper drawing and each component is returned to an initial state.

In addition, the magnetic attenuation iron 117 included in the first electromagnetic electrical connection part 100 serve to prevent properties of magnetic force from being transferred to the electronic product.

Meanwhile, FIG. 3 shows the first embodiment without the spring 194 and the auxiliary plug terminal 196 of the second embodiment. In the first embodiment, the plug terminal operation portion 170 has a simple configuration and the first and second electromagnetic electrical connection parts 100 and 100*a* come into contact with each other by magnetic force.

In addition, a description will be given of third embodiment of the electromagnetic electrical connection device according to the present invention.

That is, the present embodiment is configured such that the above-mentioned second electromagnetic electrical connection part 100*a* selectively comes into contact with or is decoupled from a third electromagnetic electrical connection part 200.

In this case, the third electromagnetic electrical connection part 200 includes an outlet body 210 which is formed, at one side thereof, with a locking protrusion 211 protruding therefrom such that the locking protrusion 211 is fitted into the locking groove 151 while being formed therein with terminal holes 212 at regular intervals such that a plurality of outlet terminals 213 are fitted into the terminal holes 212; and first and second magnets 215 and 216 which are respectively provided at a front end of one side of and inside the outlet body 210.

The present invention may include and use a circular insulator and a magnet which are provided around each outlet terminal 213. This enables the flow of electric current through the magnet to be prevented by the insulator interposed between the outlet terminal 213 and the magnet.

Hereinafter, operation effects of the third embodiment of the electromagnetic electrical connection device according to the present invention having the above-mentioned configure will be described.

First, since the second electromagnetic electrical connection part 100*a* operates in the same manner as the above-mentioned embodiments, the detailed description thereof will be omitted herein.

However, the third electromagnetic electrical connection part 200 coupled with the second electromagnetic electrical connection part 100*a* operates as follows.

That is, when the second and third electromagnetic electrical connection parts 100*a* and 200 are coupled to each other, power is applied to the outlet terminal 213 while the main plug terminal 195 is fitted into the terminal hole 212.

In this case, the first and second magnets 215 and 216 are respectively provided on an outer peripheral surface of the terminal hole 212 and an outer peripheral surface of the outlet terminal 213 so that the parts are closely connected by the magnet 161 of the plug body 150 and properties of magnetic force.

Of course, when the parts are again spaced apart from each other in the above state, all components are returned to an initial state. The other remaining operation effects are the same as the above-mentioned embodiments.

The first, second, and third embodiments may be performed in various use states as shown in FIGS. 6 to 10. For example, the present invention may also be used by being assembled using female and male waterproof couplers, female and male couplers, female and male lamp sockets, or the like.

In addition, a description will be given of fourth embodiment of the electromagnetic electrical connection device according to the present invention.

That is, the electromagnetic electrical connection device includes a fourth electromagnetic electrical connection part 300 which is provided therein with auxiliary plug terminals 301 and magnets 303 and is provided, at an outer side thereof, with main plug terminals 302 protruding therefrom such that the main plug terminals 302 may be inserted into an outlet 350.

The electromagnetic electrical connection device includes a fifth electromagnetic electrical connection part 310 provided therein with plug terminal operation portions 170.

In addition, the electromagnetic electrical connection device includes a sixth electromagnetic electrical connection part 320 which is formed, at one side therein, with plug terminal operation portions 170 and is formed, at the other side therein, with plug terminal insertion holes 321. The electromagnetic electrical connection device is configured to be used in such a manner that the fourth and fifth electromagnetic electrical connection parts 300 and 310 are detachable from each other or the fourth and sixth electromagnetic electrical connection parts 300 and 320 are detachable from each other.

Hereinafter, operation effects of the fourth embodiment of the electromagnetic electrical connection device according to the present invention having the above-mentioned configure will be described.

Figure 11:
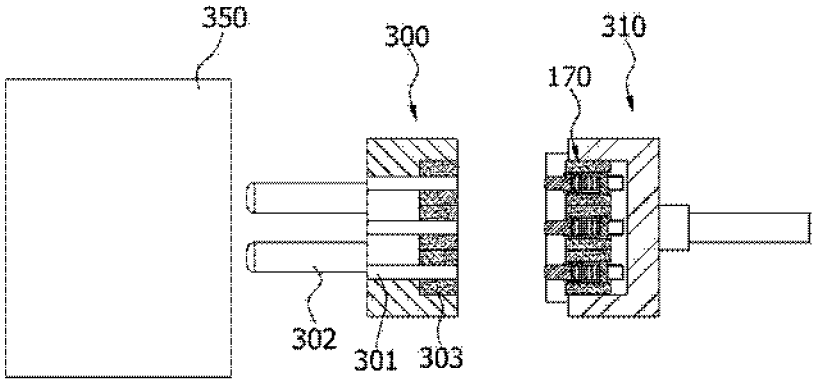
FIG. 11 is a view illustrating a use state of a fourth embodiment of the electromagnetic electrical connection device applied to the present invention.
Figure 12:
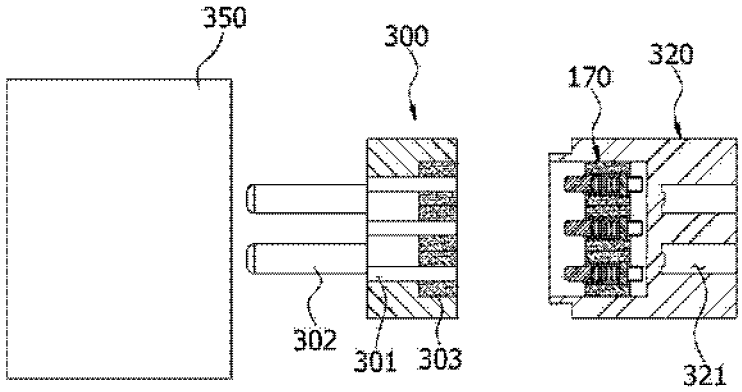
FIG. 12 is a view illustrating the use state of the fourth embodiment of the electromagnetic electrical connection device applied to the present invention.

FIGS. 11 and 12 are views illustrating various use states of the fourth embodiment of the electromagnetic electrical connection device applied to the present invention.

That is, FIG. 11 shows a state in which the fourth and fifth electromagnetic electrical connection parts 300 and 310 are connected to the outlet 350 to be used. FIG. 12 shows a state in which the fourth and sixth electromagnetic electrical connection parts 300 and 320 are connected to the outlet 350 to be used.

In more detail, when the plug terminal operation portion 170 of the fifth electromagnetic electrical connection part 310 comes into contact with the auxiliary plug terminal 301, power is applied to the main plug terminal 302. In this process, connection force is provided by mutual magnetic force between the magnet 303 and the magnet of the plug terminal operation portion 170.

In addition, when the plug terminal operation portion 170 of the sixth electromagnetic electrical connection part 320 comes into contact with the auxiliary plug terminal 301, power is applied to the main plug terminal 302. The remaining operation is the same as the above-mentioned operation. Thereafter, when the two components are separated from each other, the components are naturally returned to an initial state.

In addition, a description will be given of fifth embodiment of the electromagnetic electrical connection device according to the present invention.

That is, a female waterproof coupler 450 includes a seventh electromagnetic electrical connection part 400 therein such that a male waterproof coupler 451 is selectively detachable from the female waterproof coupler 450. The seventh electromagnetic electrical connection part 400 includes therein spring connectors 410, each of which is formed with a spring operation groove 411 such that a spring 413 is fitted into the spring operation groove 411.

The seventh electromagnetic electrical connection part 400 includes an inclined surface 421 and an operation hole 412 which are formed at one side inside the spring connector 410.

In addition, the seventh electromagnetic electrical connection part 400 includes a main outlet terminal 420 which is installed inside the spring connector 410 and is formed, at one side thereof, with a terminal tip portion 422.

The seventh electromagnetic electrical connection part 400 includes a housing 430 which is provided at the other side inside the spring connector 410 and has a hole 431 therein.

Furthermore, an auxiliary outlet terminal 440 is installed inside the housing 430.

Hereinafter, operation effects of the fifth embodiment of the electromagnetic electrical connection device according to the present invention having the above-mentioned configure will be described.

Figure 13:
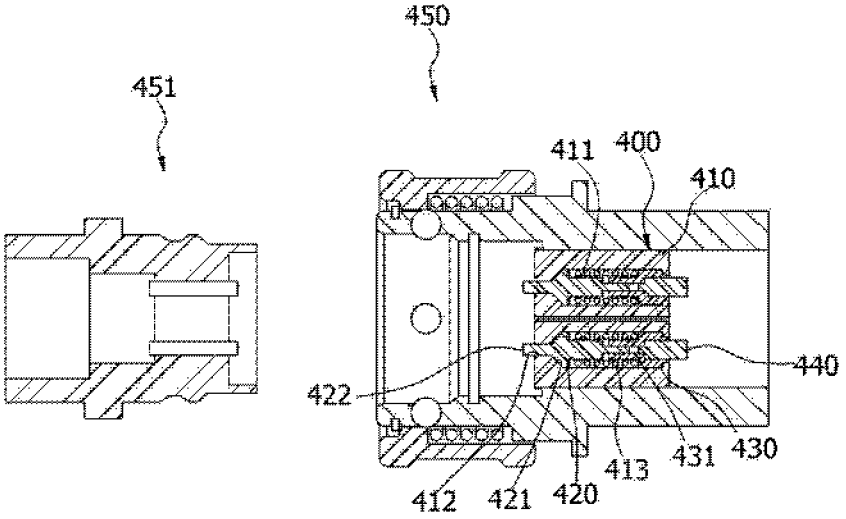
FIG. 13 is a view illustrating a use state of a fifth embodiment of the electromagnetic electrical connection device applied to the present invention.
Figure 14:
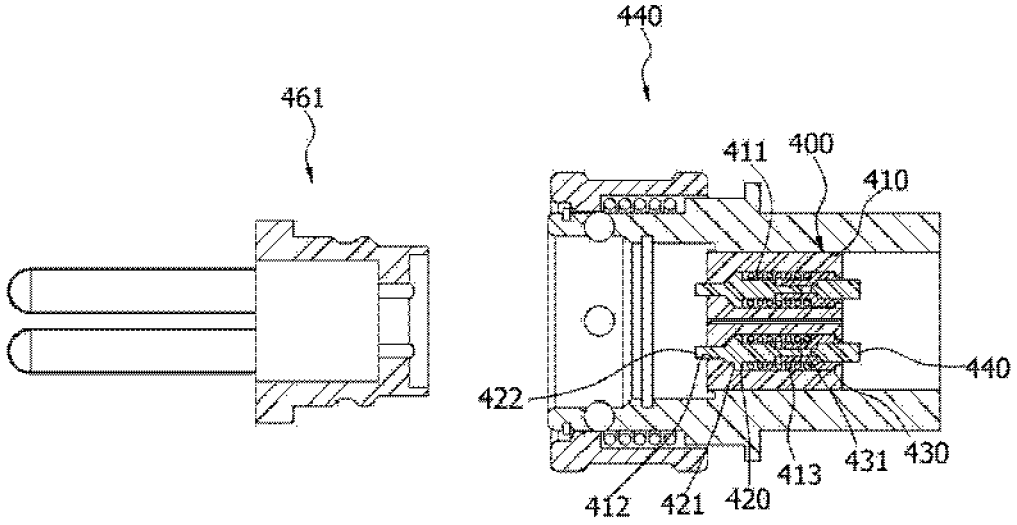
FIG. 14 is a view illustrating the use state of the fifth embodiment of the electromagnetic electrical connection device applied to the present invention.

FIGS. 13 and 14 are views illustrating various use states of the fifth embodiment of the electromagnetic electrical connection device applied to the present invention. In particular, FIG. 13 shows that the female waterproof coupler 450 is coupled to the male waterproof coupler 451, and FIG. 14 shows that a female lamp waterproof coupler 460 is coupled to a male lamp waterproof coupler 461.

In more detail, in the drawing of illustrating a state before the seventh electromagnetic electrical connection part 400 operates, when the male waterproof coupler or the male lamp waterproof coupler is inserted into the female coupler, the terminal push the terminal tip portion 422. Accordingly, the main outlet terminal 420 is inserted into the hole 431 while being pushed toward the housing 430, and thus the main outlet terminal 420 is connected to the auxiliary outlet terminal 440 to enable power to be applied thereto. In this process, the spring 431 located at the spring operation groove 411 is compressed. Particularly, since the terminal tip portion 422 is not deviated from the operation hole 412 even if the terminal tip portion 422 is pushed, the waterproof function may be maintained. Of course, when the couplers are separated from each other and the terminal tip portion 422 is returned to an original state, airtightness may be maintained in a state in which the main outlet terminal 420 is not ejected outward at all by the inclined surface 421.

Such a method may be applied to a coupler method or a connection method and an insertion method using the magnet.

In addition, a description will be given of sixth and seventh embodiments of the electromagnetic electrical connection device according to the present invention.

That is, the electromagnetic electrical connection device includes a eighth electromagnetic electrical connection part 500 which is detachably assembled to the product and a ninth electromagnetic electrical connection part 550 which is detachable from the eighth electromagnetic electrical connection part 500. The eighth electromagnetic electrical connection part 500 includes a body 510 in which a plurality of female terminals 514 and magnets 515 are installed therein at regular intervals, a pair of locking groove 511 and catching groove 512 are formed at one side thereof, and a catching piece 513 is formed inside the catching groove 512.

The ninth electromagnetic electrical connection part 550 includes a body 560 in which a plurality of male terminals 562 and magnets 565 are installed therein at regular intervals, a pair of locking protrusion 561 and catching protrusion 563 are formed at one side thereof, and a connector 570 is installed behind the male terminals.

In addition, the electromagnetic electrical connection device is configured such that the eighth electromagnetic electrical connection part 500, which is detachable from the ninth electromagnetic electrical connection part 550, is integrally or detachably installed to a variety of electronic devices or communication terminals (for example, mobile phones, PDAs, notebooks, mobile phone cases, etc.).

Hereinafter, operation effects of the sixth and seventh embodiments of the electromagnetic electrical connection device according to the present invention having the above-mentioned configure will be described.

Figure 15:
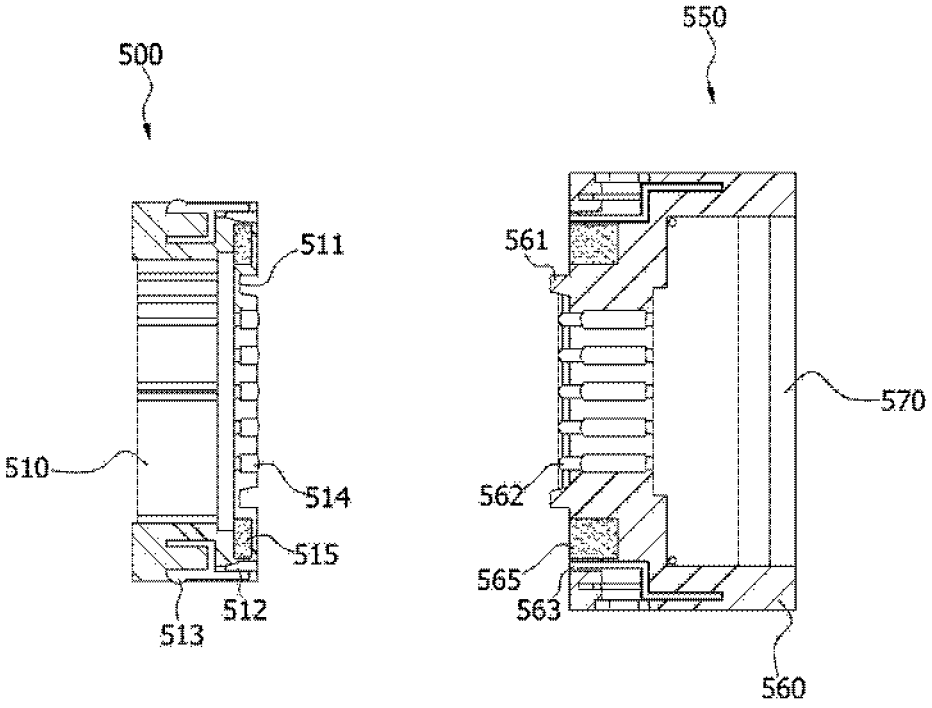
FIG. 15 is a view illustrating a configuration of a sixth embodiment of the electromagnetic electrical connection device applied to the present invention.
Figure 16:
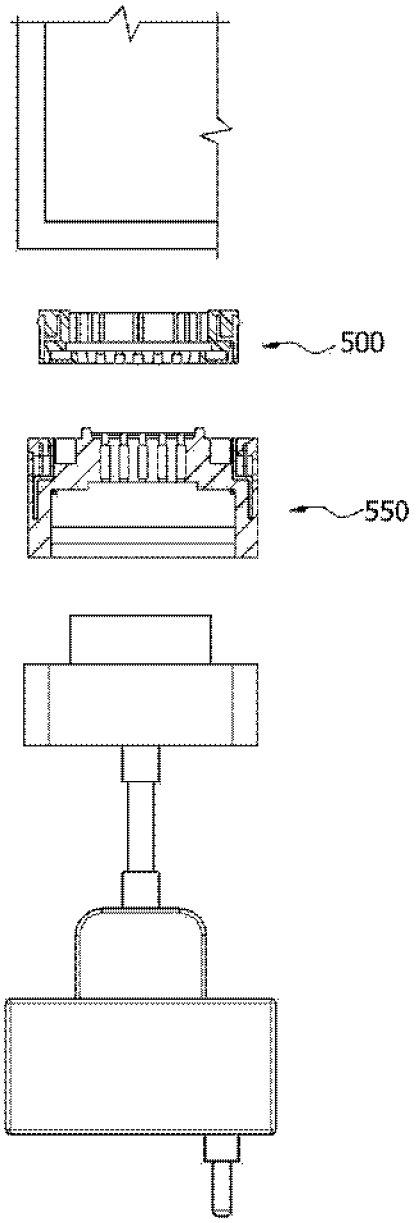
FIG. 16 is a view illustrating a use state of a seventh embodiment of the electromagnetic electrical connection device applied to the present invention.
Figure 17:
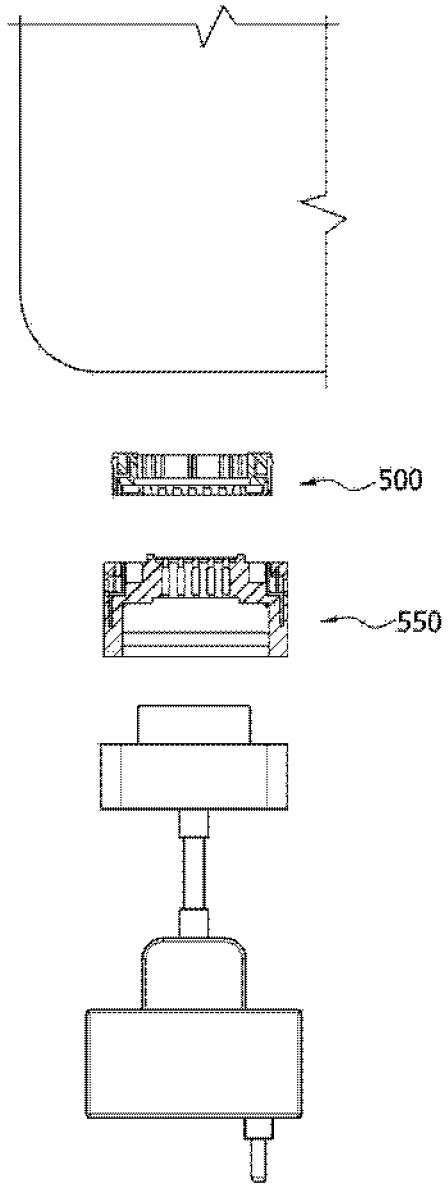
FIG. 17 is a view illustrating the use state of the seventh embodiment of the electromagnetic electrical connection device applied to the present invention.

FIG. 15 is a view illustrating a configuration of the sixth embodiment of the electromagnetic electrical connection device applied to the present invention. FIGS. 16 and 17 are views illustrating various use states of the seventh embodiment of the electromagnetic electrical connection device applied to the present invention.

In more detail, the eighth electromagnetic electrical connection part 500 may be fixedly installed to or selectively detachable from the electronic product.

When the ninth electromagnetic electrical connection part 550 is coupled to the eighth electromagnetic electrical connection part 500, the locking protrusion 561 is fitted into the locking groove 511. In this process, the male terminal 562 is fitted into the female terminal 514 to enable power to be applied to the electromagnetic electrical connection device. The magnet of one side body 560 and the magnet of the other side body 560 generate attractive force by properties of magnetic force therebetween, and thus the eighth electromagnetic electrical connection part 500 and the ninth electromagnetic electrical connection part 550 are closely pressed against each other.

Particularly, the catching piece 513 of the body 510 is performed such that the eighth electromagnetic electrical connection part 500 may be securely installed to the electronic product, and the catching protrusion 563 of the body 560 is caught by the catching groove 512 and is performed such that the two bodies 560 and 510 may be closely installed to each other.

Of course, the eighth electromagnetic electrical connection part 500 and the ninth electromagnetic electrical connection part 550 may be simply decoupled from each other when the above operation is reversely performed.

In addition, a description will be given of eighth embodiment of the electromagnetic electrical connection device according to the present invention.

That is, the electromagnetic electrical connection device includes a tenth electromagnetic electrical connection part 600 and an eleventh electromagnetic electrical connection part 650 which is detachable, at one end thereof, from the tenth electromagnetic electrical connection part and is detachable, at the other end thereof, from a charger 660 provided with a jack 661. The tenth electromagnetic electrical connection part 600 includes a body 610 which is provided, at one side thereof, with a plurality of terminals 611 and a magnet 613 and is formed, at the other side thereof, with a jack 612 protruding therefrom such that the jack 612 is detachable from the electronic product.

In addition, the eleventh electromagnetic electrical connection part 650 includes a body 651 which is provided, at one side thereof, with plug terminal operation portions 170 and a magnet 653 and is formed, at the other side thereof, with a jack insertion hole 652 from which a jack is detachable.

Hereinafter, operation effects of the eighth embodiment of the electromagnetic electrical connection device according to the present invention having the above-mentioned configure will be described.

Figure 18:
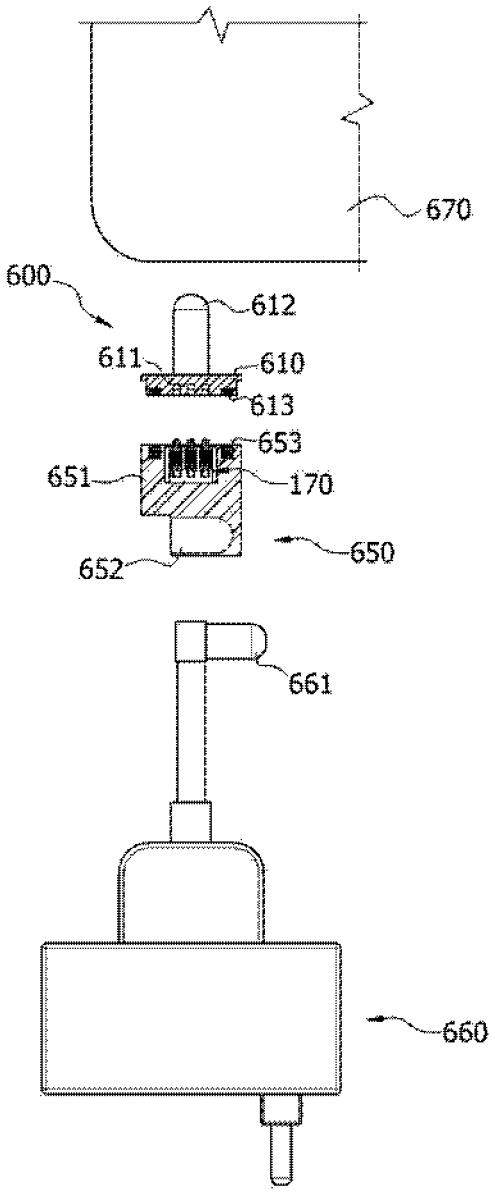
FIG. 18 is a view illustrating a configuration of an eighth embodiment of the electromagnetic electrical connection device applied to the present invention.

FIG. 18 is a view illustrating a configuration of the eighth embodiment of the electromagnetic electrical connection device applied to the present invention.

In more detail, the tenth electromagnetic electrical connection part 600 is assembled to an electronic product 670, and the jack 612 is fitted into a hole of the electronic product.

The eleventh electromagnetic electrical connection part 650 is coupled to the tenth electromagnetic electrical connection part 600, and the plug terminal operation portion 170 is connected to the terminal 611. In this case, the tenth electromagnetic electrical connection part and the eleventh electromagnetic electrical connection part may be closely pressed against each other by properties of the magnets 653 and 613. The eleventh electromagnetic electrical connection part 650 is connected, at one end thereof, with the charger 660 such that the jack 661 is fitted into the jack insertion hole 652. As a result, power of the charger may be applied to the electronic product.

Of course, the components may be simply decoupled from each other when the above operation is reversely performed.

Meanwhile, the present invention can be modified in various ways and take many different forms, in applying the above configuration.

Although the present invention has been described with respect to the illustrative embodiments, it will be apparent to those skilled in the art that various variations and modifications may be made without departing from the spirit and scope of the invention as defined in the following claims. Various embodiments have been described in the best mode for carrying out the invention.

INDUSTRIAL APPLICABILITY

In fact, the technical idea of an improved structure of an electromagnetic electrical connection device according to the present invention can repeatedly execute the same results, and can in particular contribute to the development of the industry to promote the development of the technology by carrying out the present invention.

What is claimed is:

1. An improved structure of an electromagnetic electrical connection device including first and second electromagnetic electrical connection parts which realize noise isolation, stability, and waterproofing functions during electrical connection of the electrical connection device of an electronic product by magnetic force, the first and second electromagnetic electrical connection parts respectively including an outlet body which is fixedly installed to the product and a plug body which is selectively detachable from the outlet body, the second electromagnetic electrical connection part selectively coming into contact with or being decoupled from a third electromagnetic electrical connection part, wherein the outlet body comprises:

an inner operation space portion, and a plurality of connection terminals which are arranged at regular intervals on one side locking protrusion;

a housing which is installed inside the operation space portion to selectively slide;

a magnet which is fixedly installed to the housing; and a plurality of outlet terminal operation portions which are installed at regular intervals to the housing such that the outlet terminal operation portions come into contact with or are decoupled from the connection terminals.

2. The improved structure of an electromagnetic electrical connection device according to claim 1, wherein the housing further comprises a magnetic attenuation iron to prevent magnetic properties of the magnet from being transferred to the product.

3. The improved structure of an electromagnetic electrical connection device according to claim 1, wherein each of the outlet terminal operation portions comprises:

a spring connector, opposite ends of which are respectively formed with spring operation grooves;

a main outlet terminal and an auxiliary outlet terminal which are respectively fitted into the spring operation grooves;

a spring which is installed inside the main outlet terminal; and a spring which is installed on an intermediate outer peripheral surface of the auxiliary outlet terminal.

4. The improved structure of an electromagnetic electrical connection device according to claim 1, wherein the third electromagnetic electrical connection part comprises:

an outlet body which is formed, at one side thereof, with a locking protrusion protruding therefrom such that the locking protrusion is fitted into a locking groove while being formed therein with terminal holes at regular intervals such that a plurality of outlet terminals are fitted into the terminal holes; and first and second magnets which are respectively provided at a front end of one side of and inside the outlet body, or the third electromagnetic electrical connection part comprising a circular insulator and a magnet which are provided around each outlet terminal to use the same.

5. The improved structure of an electromagnetic electrical connection device according to claim 1, wherein the electromagnetic electrical connection device comprises:

a fourth electromagnetic electrical connection part which is provided therein with an auxiliary plug terminal and a magnet and is provided, at an outer side thereof, with a main plug terminal protruding therefrom such that the main plug terminal is capable of being inserted into an outlet;

a fifth electromagnetic electrical connection part which is provided therein with a plug terminal operation portion; and a sixth electromagnetic electrical connection part which is formed, at one side therein, with a plug terminal operation portion and is formed, at the other side therein, with a plug terminal insertion hole, and wherein the electromagnetic electrical connection device is configured to be used in such a manner that the fourth and fifth electromagnetic electrical connection parts are detachable from each other or the fourth and sixth electromagnetic electrical connection parts are detachable from each other.

6. The improved structure of an electromagnetic electrical connection device according to claim 1, wherein in the electromagnetic electrical connection device, a female waterproof coupler comprises a seventh electromagnetic electrical connection part therein such that a male waterproof coupler is selectively detachable from the female waterproof coupler, and wherein the seventh electromagnetic electrical connection part comprises:

a spring connector formed therein with a spring operation groove into which a spring is fitted;

an inclined surface and an operation hole which are formed at one side inside the spring connector;

a main outlet terminal which is installed inside the spring connector and is formed, at one side thereof, with a terminal tip portion;

a housing which is provided at the other side inside the spring connector and has a hole therein; and an auxiliary outlet terminal installed inside the housing.

7. The improved structure of an electromagnetic electrical connection device according to claim 1, wherein:

the electromagnetic electrical connection device comprises a tenth electromagnetic electrical connection part and an eleventh electromagnetic electrical connection part which is detachable, at one end thereof, from the tenth electromagnetic electrical connection part and is detachable, at the other end thereof, from a charger provided with a jack;

the tenth electromagnetic electrical connection part comprises a body which is provided, at one side thereof, with a plurality of terminals and a magnet and is formed, at the other side thereof, with a jack protruding therefrom such that the jack is detachable from the electronic product; and the eleventh electromagnetic electrical connection part comprises a body which is provided, at one side thereof, with a plug terminal operation portion and a magnet and is formed, at the other side thereof, with a jack insertion hole from which a jack is detachable.

8. The improved structure of an electromagnetic electrical connection device according to claim 1, wherein:

the electromagnetic electrical connection device comprises a eighth electromagnetic electrical connection part which is detachably assembled to the product and a ninth electromagnetic electrical connection part which is detachable from the eighth electromagnetic electrical connection part;

the eighth electromagnetic electrical connection part comprises a body in which a plurality of female terminals and magnets are installed therein at regular intervals, a pair of locking groove and catching groove are formed at one side thereof, and a catching piece is formed inside the catching groove; and the ninth electromagnetic electrical connection part comprises a body in which a plurality of male terminals and magnets are installed therein at regular intervals, a pair of locking protrusion and catching protrusion are formed at one side thereof, and a connector is installed behind the male terminals.

9. The improved structure of an electromagnetic electrical connection device according to claim 8, wherein the eighth electromagnetic electrical connection part, which is detachable from the ninth electromagnetic electrical connection part, is integrally or detachably installed to a communication terminal (for example, a mobile phone, a PDA, a notebook, a mobile phone case, or the like).

10. The improved structure of an electromagnetic electrical connection device according to claim 1, wherein the plug body comprises:

a housing which is fixedly installed to an inner locking groove a magnet or an iron which is fixedly installed to the housing; and plug terminal operation portions which are fixedly installed at regular intervals to the housing such that the plug terminal operation portions selectively come into contact with or are decoupled from the connection terminals.

11. The improved structure of an electromagnetic electrical connection device according to claim 10, wherein the plug terminal operation portion comprises a spring connector in which a main plug terminal is installed at a front end thereof and a spring is fitted into an inner spring operation groove.

12. The improved structure of an electromagnetic electrical connection device according to claim 10, wherein the plug terminal operation portion comprises:

a spring connector in which a main plug terminal is installed at a front end thereof and a spring is fitted into an inner spring operation groove; and an auxiliary plug terminal which is provided at one end of the spring connector and in which a spring is fitted into an inner spring operation groove.

* * * * *